US011427013B2

(12) United States Patent
Tokuyama

(10) Patent No.: US 11,427,013 B2
(45) Date of Patent: Aug. 30, 2022

(54) LIQUID DISCHARGE APPARATUS

(71) Applicant: Kohji Tokuyama, Ibaraki (JP)

(72) Inventor: Kohji Tokuyama, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/147,190

(22) Filed: Jan. 12, 2021

(65) Prior Publication Data

US 2021/0260889 A1 Aug. 26, 2021

(30) Foreign Application Priority Data

Feb. 21, 2020 (JP) ..... JP2020-028686

(51) Int. Cl.
*B41J 2/19* (2006.01)

(52) U.S. Cl.
CPC ..... *B41J 2/19* (2013.01)

(58) Field of Classification Search
CPC ..... B41J 2/17563; B41J 2/17596; B41J 2202/12; B41J 2/19; B41J 2/18; B41J 2002/14403; B41J 2/175; B41J 2/17513
See application file for complete search history.

(56) References Cited

U.S. PATENT DOCUMENTS

2018/0147854 A1 5/2018 Yoshida et al.
2018/0170066 A1* 6/2018 Ohtsu ..... B41J 2/18
2019/0092034 A1* 3/2019 Goto ..... B41J 2/18

FOREIGN PATENT DOCUMENTS

JP 2014-094505 5/2014
JP 2018-089949 6/2018

* cited by examiner

*Primary Examiner* — Jannelle M Lebron
(74) *Attorney, Agent, or Firm* — Duft & Bornsen, PC

(57) ABSTRACT

A liquid discharge apparatus includes a liquid discharge head to discharge liquid, a liquid circulation path including the liquid discharge head, an exhaust path connected to the liquid circulation path on a downstream side of the liquid discharge head in a circulation direction of the liquid, and circuitry. The liquid circulation path circulates the liquid via the liquid discharge head. The circuitry opens and closes between the liquid circulation path and the exhaust path to exhaust bubbles in the liquid circulation path to an outside of the liquid circulation path through the exhaust path when the liquid is circulated in the liquid circulation path.

5 Claims, 10 Drawing Sheets

LIQUID DISCHARGE APPARATUS

CROSS-REFERENCE TO RELATED APPLICATION

This patent application is based on and claims priority pursuant to 35 U.S.C. § 119(a) to Japanese Patent Application No. 2020-028686, filed on Feb. 21, 2020, in the Japan Patent Office, the entire disclosure of which is hereby incorporated by reference herein.

BACKGROUND

Technical Field

Aspects of the present disclosure relate to a liquid discharge apparatus.

Description of the Related Art

In recent years, image forming apparatuses have been developed that form images by discharging liquid (e.g., ink) onto various recording media using inkjet technology. In particular, in an image forming apparatus to form images on an impermeable recording media, liquid to be used has high drying performance. Since such a liquid contains a large amount of solid ingredients, some image forming apparatuses have been developed that include a circulation mechanism to circulate the liquid so that the liquid does not dry and does not agglutinate while the liquid is not discharged.

There is known an image forming apparatus as an example of a liquid discharge apparatus that includes a liquid circulation path for supplying liquid to a plurality of liquid discharge heads. The liquid discharge apparatus includes a liquid circulation device including a liquid feed pump, a sub tank, a manifold to supply liquid to the liquid discharge heads (circulation heads) and circulate the liquid while controlling the circulation pressure of the liquid. The liquid feed pump performs feedback control based on an output of a liquid pressure sensor in the liquid circulation path for each of the liquid discharge heads. A "gas-liquid interface" corresponding to a boundary surface between gas and liquid is disposed in the sub tank. The manifold is disposed at the highest position in the liquid circulation path. In the liquid discharge apparatus including such a liquid circulation device, a bubble removal technique is used to prevent a flow of liquid by the liquid feed pump in the liquid circulation path from being blocked by bubbles. The liquid circulation path supplies and circulates liquid to be used by the liquid discharge heads.

SUMMARY

Embodiments of the present disclosure describe an improved liquid discharge apparatus that includes a liquid discharge head to discharge liquid, a liquid circulation path including the liquid discharge head, an exhaust path connected to the liquid circulation path on a downstream side of the liquid discharge head in a circulation direction of the liquid, and circuitry. The liquid circulation path circulates the liquid via the liquid discharge head. The circuitry opens and closes between the liquid circulation path and the exhaust path to exhaust bubbles in the liquid circulation path to an outside of the liquid circulation path through the exhaust path when the liquid is circulated in the liquid circulation path.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
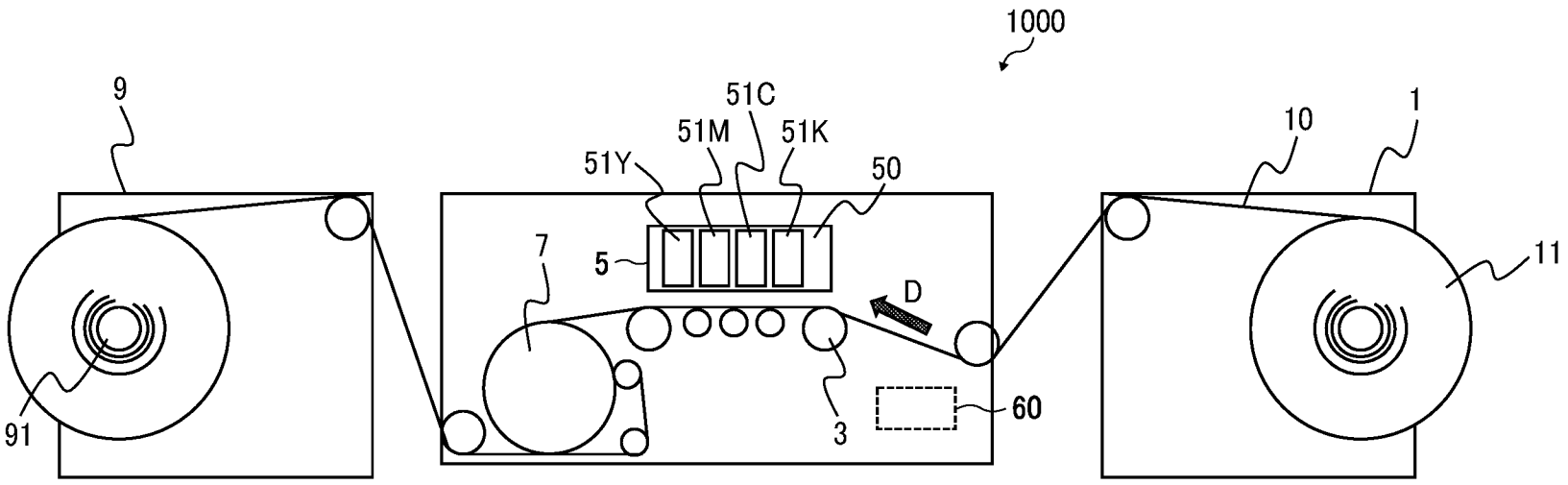
FIG. 1 is a schematic view illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views, and the description of which are omitted as appropriate.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

In attempting to improve a bubble exhaust performance without blocking the flow of liquid, a comparative liquid circulation device uses a technique in which bubbles in a liquid circulation path are accumulated in a manifold of the liquid circulation path, and the accumulated bubbles are sent to a gas portion in a sub tank of the liquid circulation path disposed downstream from the manifold through a separate path different from the liquid circulation path.

However, in the bubble removal technique used in the comparative liquid circulation device, the liquid level in the sub tank of the liquid circulation path, which is maintained at a negative pressure during liquid circulation, may not be raised by opening to the atmosphere. Accordingly, even if the bubble removal technique is applied to a liquid discharge apparatus, the gas volume in the sub tank of the liquid circulation path, to which bubbles in the manifold is exhausted, may not be controlled to a constant volume. As a result, the gas volume may increase with the bubble exhaust, the damper effect may change, and the feedback control of the liquid feed pump by a pressure sensor in the liquid circulation path may be disturbed, so that the meniscus pressure in the nozzle of the liquid discharge head may become unstable. Therefore, when an image forming apparatus to form images on recording media includes the liquid discharge apparatus to which the above-described bubble removal technique is applied, the image quality of images formed on the recording media may deteriorate.

The present disclosure has been made in view of the above, and an object of the present disclosure is to prevent the deterioration of the image quality caused by bubbles generated in the liquid circulation path.

Embodiments according to the present disclosure are described below. However, the present disclosure is not intended to be limited to the embodiments described herein.

FIG. 1 is a schematic view illustrating a configuration of an image forming apparatus 1000 according to the present embodiment. The image forming apparatus 1000 is an example of a liquid discharge apparatus according to the embodiment of the present disclosure. In FIG. 1, the image forming apparatus 1000 includes an unwinding device 1, a conveyance unit 3, and a printing unit 5. The unwinding device 1 feeds a continuous medium 10 that is a sheet-shaped and continuous recording medium. The conveyance unit 3 conveys the continuous medium 10 fed by the unwinding device 1 to the printing unit 5. The printing unit 5 discharges liquid such as ink onto the continuous medium 10 to form images. The image forming apparatus 1000 further includes a drier unit 7 that dries the continuous medium 10 and a winding device 9 that ejects the continuous medium 10.

The continuous medium 10 is fed from a media roller 11 of the unwinding device 1, guided and conveyed with rollers of the unwinding device 1, the conveyance unit 3, the drier unit 7, and the winding device 9, and wound around a winding roller 91 of the winding device 9. The continuous medium 10 is conveyed facing a head unit 50 of the printing unit 5. The head unit 50 discharges liquid to form images on the continuous medium 10. The head unit 50 includes four-color full-line head arrays 51K, 51C, 51M, and 51Y (hereinafter, simply referred to as the "head array 51" unless colors are distinguished) from an upstream side in a conveyance direction of the continuous medium 10 indicated by arrow D in FIG. 1.

A controller 60 as circuitry includes at least an interface to electrically connect various devices, for example, an arithmetic processing device such as a central processing unit (CPU), a storage device such as a memory and a hard disk drive (HDD), a sensor, and a control device. The controller 60 controls the overall operation of the image forming apparatus 1000 in conjunction with the unwinding device 1 and the winding device 9.

Figure 2:
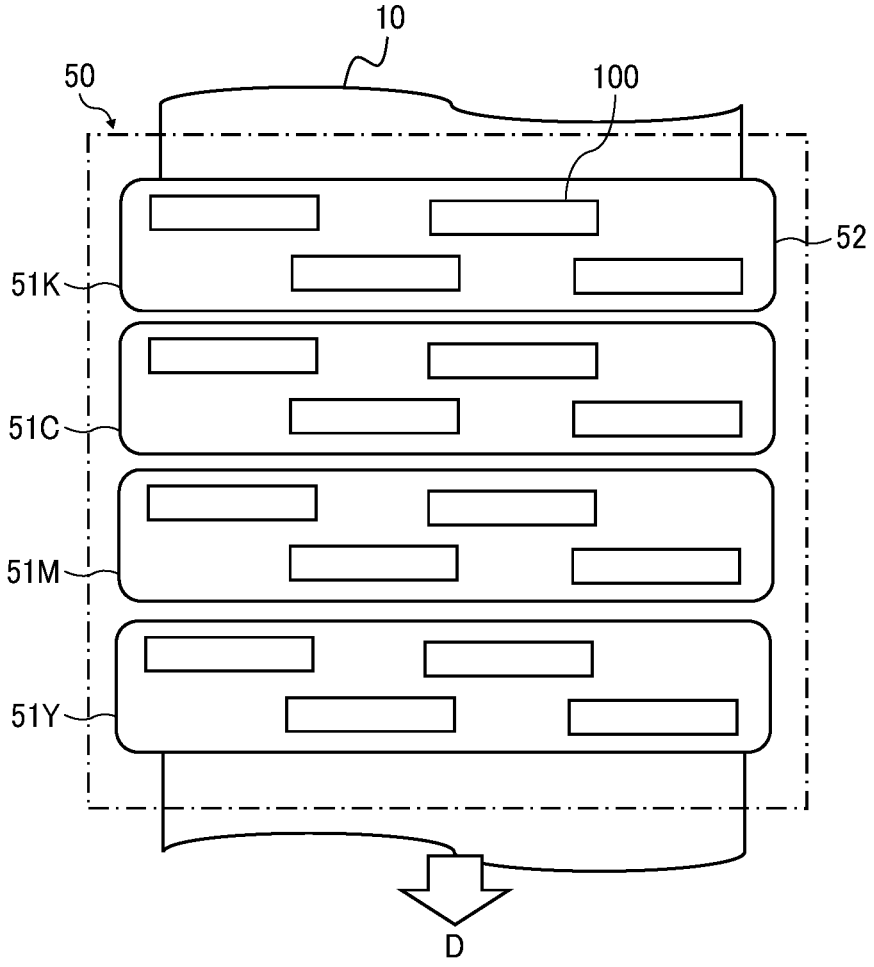
FIG. 2 is a plan view illustrating an example of a head unit of the image forming apparatus in FIG. 1.

FIG. 2 is a schematic plan view of the head unit 50. The head unit 50 includes, for example, the head arrays 51K, 51C, 51M, and 51Y for four colors from the upstream side in the conveyance direction of the continuous medium 10 indicated by arrow D in FIG. 2. In each head array 51, a plurality of liquid discharge heads 100 (hereinafter, simply referred to as "liquid discharge heads 100") is disposed in a staggered arrangement on a base 52. The arrangement of the liquid discharge heads 100 is not limited to the example illustrated in FIG. 2. Each of the head arrays 51 is a liquid discharge device to discharge liquid of black (K), cyan (C), magenta (M), or yellow (Y) onto the continuous medium 10 conveyed along the conveyance direction. Note that the number and types of colors are not limited to the above-described four colors of K, C, M, and Y and may be any other suitable number and types.

Figure 3:
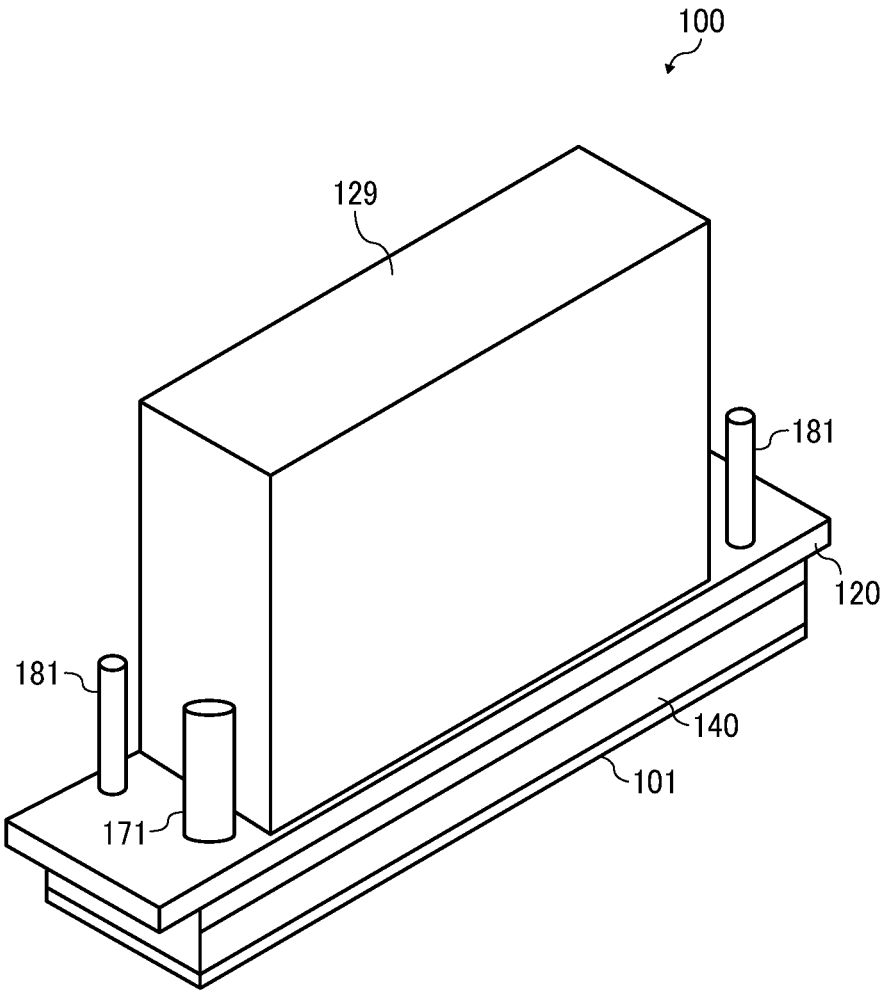
FIG. 3 is an external perspective view illustrating an example of a liquid discharge head of the head unit in FIG. 2.
Figure 4:
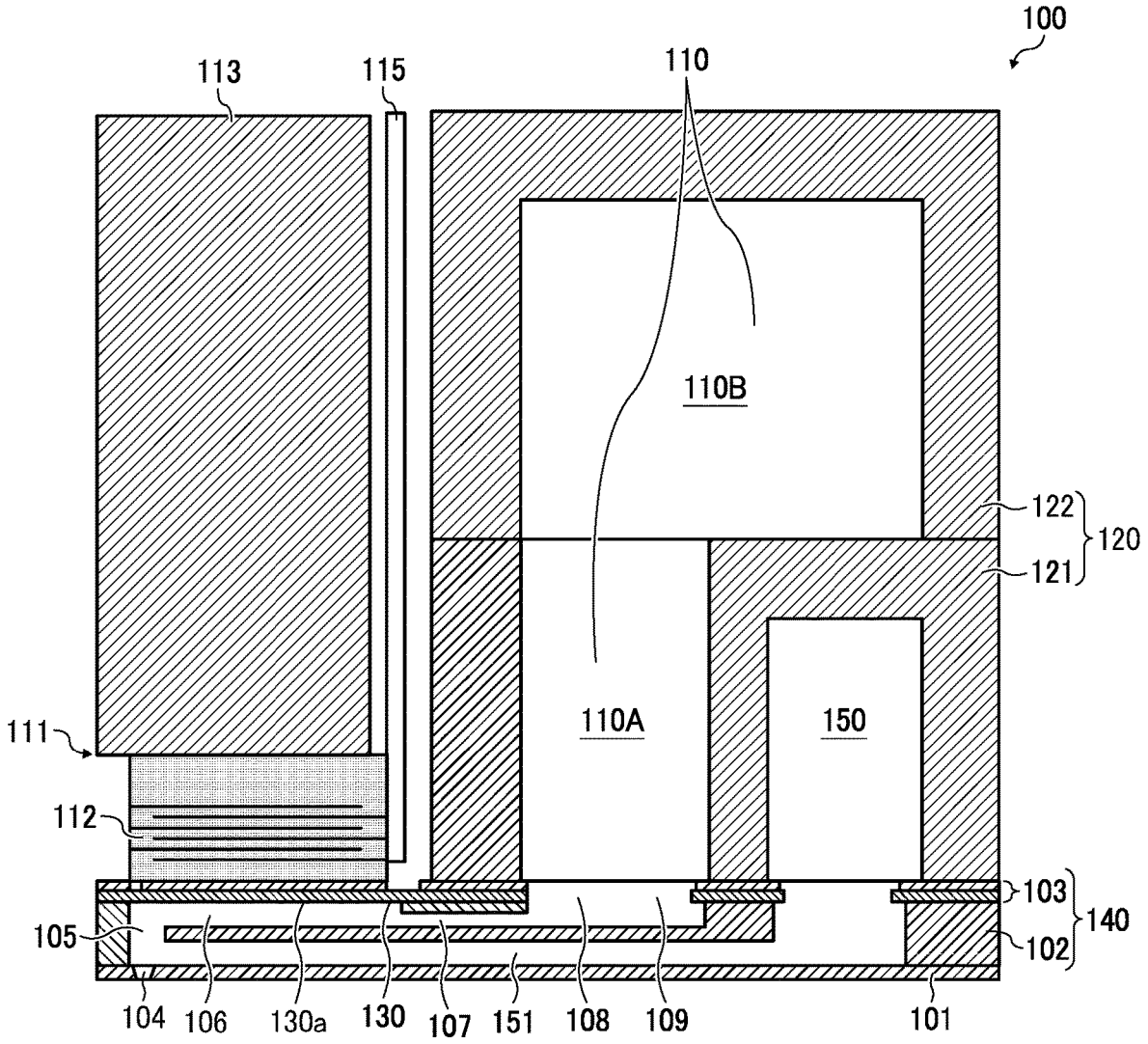
FIG. 4 is a cross-sectional view of the liquid discharge head illustrated in FIG. 3 along the direction perpendicular to a nozzle array direction thereof (the longitudinal direction of a liquid chamber)

Next, the liquid discharge head 100 according to the present embodiment is described with reference to FIGS. 3 and 4. FIG. 3 is an external perspective view of the liquid discharge head 100. FIG. 4 is a cross-sectional view of the liquid discharge head 100 along the direction perpendicular to a nozzle array direction that is the same as the longitudinal direction of a liquid chamber.

As illustrated in FIG. 3, the liquid discharge head 100 includes a nozzle plate 101, a channel substrate 140 stacked on the nozzle plate 101, a common-chamber substrate 120 stacked on the channel substrate 140, and a cover 129 covering an upper portion of the common-chamber substrate 120. The common-chamber substrate 120 also serves as a frame of the liquid discharge head 100. The cover 129 is rectangular parallelepiped. The common-chamber substrate 120 defines a supply-side common liquid chamber 110 and a delivery-side common liquid chamber 150, which are described later. A supply port 171 communicating with the supply-side common liquid chamber 110 and a delivery port 181 communicating with the delivery-side common liquid chamber 150 are disposed on the upper surface of the common-chamber substrate 120.

Next, the interior of the liquid discharge head 100 is described with reference to FIG. 4. The liquid discharge head 100 includes the nozzle plate 101, a channel plate 102, and a diaphragm member 103 that construct a multi-layer structure laminated one on another and bonded to each other. The diaphragm member 103 serves as a wall of the channel plate 102. Hereinafter, the "liquid discharge head 100" may be simply referred to as the "head 100". The head 100 further includes a piezoelectric actuator 111 and the common-chamber substrate 120. The piezoelectric actuator 111 displaces a vibration portion 130 of the diaphragm member 103. The common-chamber substrate 120 serves as the frame of the head 100. A portion of the head 100 constructed of the channel plate 102 and the diaphragm member 103 corresponds to the channel substrate 140.

The nozzle plate 101 includes a plurality of nozzles 104 that is discharge ports to discharge liquid. The channel plate 102 includes individual liquid chambers 106, liquid resistance channels 107, and liquid inlets 108. The individual liquid chambers 106 communicate with the nozzles 104 via nozzle communication channels 105, respectively. The liquid resistance channels 107 communicate with the individual liquid chambers 106, respectively. The liquid inlets 108 communicate with liquid resistance channels 107, respectively. The nozzle communication channels 105 connect the nozzles 104 and the individual liquid chambers 106, respectively. The liquid inlets 108 communicate with the supply-side common liquid chamber 110 through openings 109 of the diaphragm member 103.

The diaphragm member 103 includes the deformable vibration portion 130 serving as the wall of the individual liquid chambers 106 of the channel plate 102. In the present embodiment, the diaphragm member 103 has, but not limited to, a double-layer structure and includes a first layer serving as a thin portion and a second layer serving as a thick portion from the side of channel plate 102. The first layer includes the deformable vibration portion 130 positioned corresponding to the individual liquid chamber 106.

The head 100 includes a piezoelectric actuator 111 including an electromechanical transducer element as a driving device (actuator device or pressure generator) to deform the vibration portion 130 of the diaphragm member 103. The piezoelectric actuator 111 is disposed on the side opposite the individual liquid chamber 106 through the diaphragm member 103. The piezoelectric actuator 111 includes piezoelectric elements 112 bonded on a base 113. The piezoelectric elements 112 are groove-processed by half cut dicing to form a comb shape including a desired number of pillar-shaped elements that are arranged at certain intervals. The piezoelectric element 112 is bonded to a projection 130*a*, which is an island-shaped thick portion on the vibration portion 130 of the diaphragm member 103. A flexible wiring board 115 is connected to the piezoelectric element 112.

The common-chamber substrate 120 defines the supply-side common liquid chamber 110 and the delivery-side common liquid chamber 150. As described above, the supply-side common liquid chamber 110 communicates with the supply port 171 illustrated in FIG. 3, and the delivery-side common liquid chamber 150 communicates with the delivery port 181 illustrated in FIG. 3. The supply port 171 and the delivery port 181 are connected to a liquid circulation device 500 that circulates and supplies the liquid to each liquid discharge head 100. The liquid circulation device 500 is described later. The common-chamber substrate 120 includes a first common-chamber substrate 121 and a second common-chamber substrate 122. The first common-chamber substrate 121 is bonded to the diaphragm member 103 of the channel substrate 140. The second common-chamber substrate 122 is stacked on and bonded to the first common-chamber substrate 121. The first common-chamber substrate 121 defines a downstream common chamber 110A and the delivery-side common liquid chamber 150. The downstream common chamber 110A is a part of the supply-side common liquid chamber 110 communicating with the liquid inlets 108. The delivery-side common liquid chamber 150 communicates with delivery channels 151. The second common-chamber substrate 122 defines an upstream common chamber 110B that is the other part of the supply-side common liquid chamber 110. The channel plate 102 further includes the delivery channels 151 extending in the lateral direction in FIG. 4. The delivery channels 151 communicate with the individual liquid chambers 106 via the nozzle communication channels 105, respectively. The delivery channels 151 also communicate with the delivery-side common liquid chamber 150.

In the head 100, for example, when a voltage applied to the piezoelectric element 112 is lowered below a reference potential (intermediate potential), the piezoelectric element 112 contracts. The piezoelectric actuator 111 pull the vibration portion 130 of the diaphragm member 103 by such a contraction, and the volume of the individual liquid chamber 106 increases. By such an operation, liquid flows into the individual liquid chamber 106. When the voltage applied to the piezoelectric element 112 is raised, the piezoelectric element 112 expands in the direction of lamination thereof. As a result, the vibration portion 130 of the diaphragm member 103 deforms in the direction toward the nozzle 104 and contracts the volume of the individual liquid chamber 106. By such an operation, the liquid in the individual liquid chamber 106 is pressurized, and the liquid is discharged from the nozzle 104. The liquid that is not discharged from the nozzle 104 passes through the nozzle 104 and is delivered to the delivery-side common liquid chamber 150 through the delivery channel 151. Then, the liquid is delivered from the delivery-side common liquid chamber 150 to a liquid circulation path 400 described later and supplied to the supply-side common liquid chamber 110 again through the liquid circulation path 400. The drive method of the head 100 is not limited to the above-described method (i.e., pull-push discharging). The way of discharging changes depending on how a drive waveform is applied. For example, pull discharging or push discharging is possible.

Figure 5:
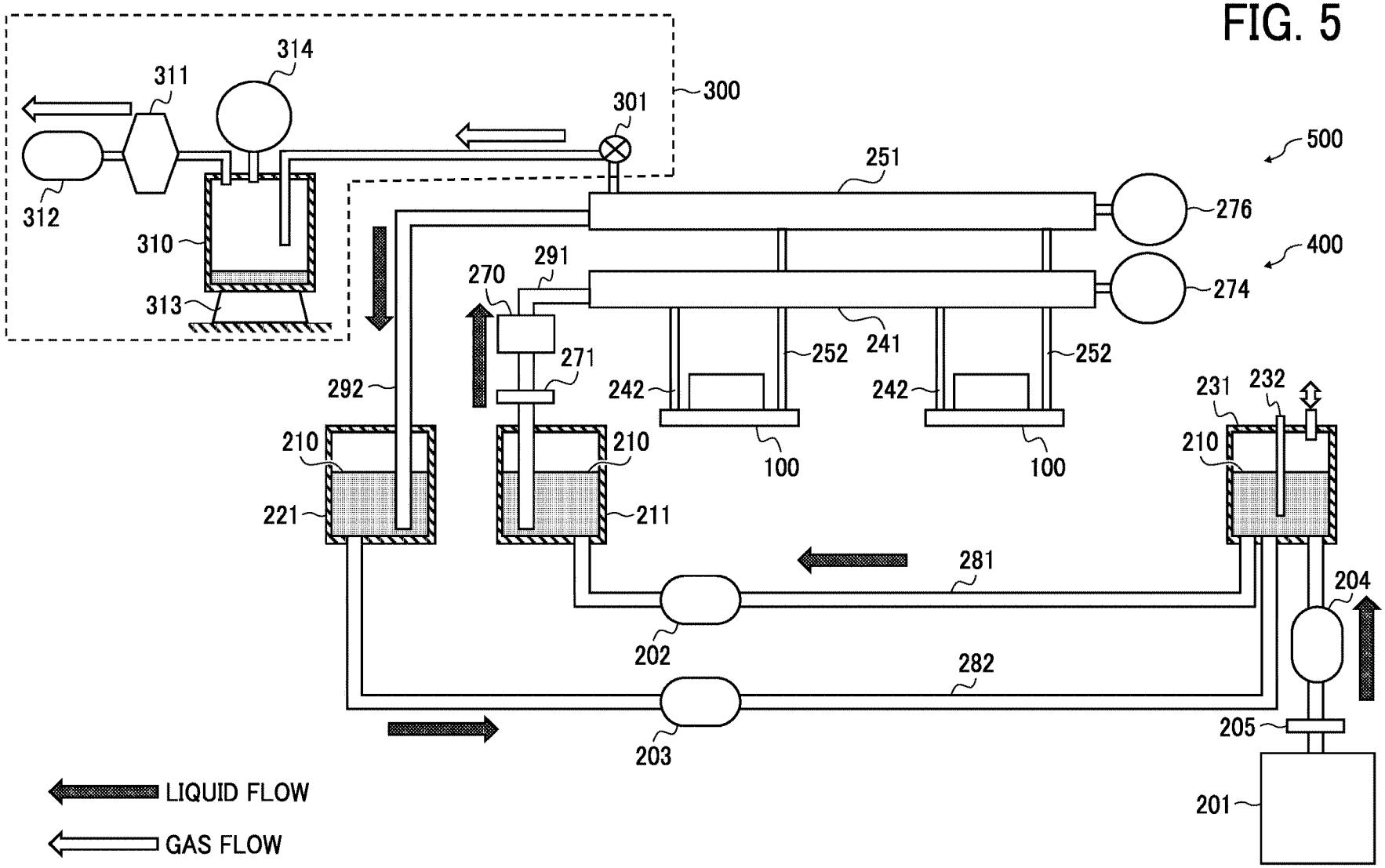
FIG. 5 is a schematic view of a liquid circulation device of the image forming apparatus according to an embodiment of the present disclosure.

FIG. 5 is a schematic view illustrating an example of a liquid circulation device 500 according to the present embodiment. In FIG. 5, the arrows illustrated in black indicates the flow of liquid, and the arrows illustrated in white indicates the flow of gas. The liquid circulation device 500 includes the liquid circulation path 400 and an exhaust path 300. The liquid to be supplied to the head 100 is circulated through the liquid circulation path 400 via the head 100. The exhaust path 300 is connected to the liquid circulation path 400 on the downstream side of the heads 100 in the circulation direction of the liquid. The exhaust path 300 and the liquid circulation path 400 are connected via a connection valve, and the controller 60 (see FIG. 1) causes the connection valve to open and close. The controller 60 controls the connection valve so as to open between the circulation path 400 and the exhaust path 300 to exhaust bubbles in the liquid circulation path 400 to the outside of the liquid circulation path 400 through the exhaust path 300 during a liquid circulation operation in the liquid circulation path 400.

The liquid circulation device 500 includes a main tank 201, a supply-side sub tank 211, a circulation-side sub tank 221, and an intermediate sub tank 231. The main tank 201 is a liquid storage unit that stores the liquid to be discharged by the head 100. The liquid circulation device 500 further includes a supply pump 202, a circulation pump (liquid feed pump) 203, and a replenishment pump 204. The supply pump 202 feeds the liquid from the intermediate sub tank 231 to the supply-side sub tank 211. The circulation pump 203 feeds the liquid from the circulation-side sub tank 221 to the intermediate sub tank 231. The replenishment pump 204 feeds the liquid from the main tank 201 to the intermediate sub tank 231. The intermediate sub tank 231 and the supply-side sub tank 211 are connected through a supply path 281, and the supply pump 202 is disposed in the supply path 281. The intermediate sub tank 231 and the circulation-side sub tank 221 are connected through a circulation path 282, and the circulation pump 203 is disposed in the circulation path 282. Each of the sub tanks (i.e., the supply-side sub tank 211, the circulation-side sub tank 221, and the intermediate sub tank 231) has a "gas-liquid interface 210" therein, which corresponds to a boundary surface between a surface of the liquid ink stored in the sub tank and a space in the sub tank.

The liquid circulation device 500 further includes a supply-side manifold 241, a circulation-side manifold 251, and a degassing device 270. The supply-side manifold 241 and the circulation-side manifold 251 communicate with the plurality of liquid discharge heads 100. The degassing device 270 removes dissolved gas in the liquid. The supply-side manifold 241 is connected to the supply-side sub tank 211 through a supply path 291 including a circulation filter 271 and the degassing device 270. The supply-side manifold 241 is also connected to the supply ports 171 of the heads 100 through head supply paths 242. The supply-side manifold 241 is provided with a supply pressure sensor 274. The circulation-side manifold 251 is connected to the circulation-side sub tank 221 through a circulation path 292. The circulation-side manifold 251 is also connected to the delivery ports 181 of the heads 100 through a head circulation paths 252. The circulation-side manifold 251 is provided with a circulation pressure sensor (liquid pressure sensor) 276. The intermediate sub tank 231 is disposed between the supply-side sub tank 211 and the circulation-side sub tank 221. The liquid is fed from the main tank 201 through a replenishment filter 205 and a replenishment path by the replenishment pump 204. The intermediate sub tank 231 is open to the atmosphere, and the replenishment pump 204 feeds the liquid so that the liquid level in the intermediate sub tank 231 becomes a constant height. The controller 60 determines whether or not the liquid level is constant based on the reading value detected by a liquid level detector 232.

As described above, in the liquid circulation path 400, the liquid is fed from the intermediate sub tank 231 and returned to the intermediate sub tank 231 through the supply path 281, the supply-side sub tank 211, the supply path 291, the degassing device 270, the supply-side manifold 241, the head supply path 242, the liquid discharge head 100, the head circulation path 252, the circulation-side manifold 251, the circulation path 292, the circulation-side sub tank 221, and the circulation path 282. That is, the circulation pump 203 in the circulation path 282 is disposed downstream from the circulation-side manifold 251.

Target values of the supply pressure sensor 274 and the circulation pressure sensor 276 are set so as to obtain a predetermined meniscus pressure. The reading values of the supply pressure sensor 274 and the circulation pressure sensor 276 are fed back to the control of the supply pump 202 and the circulation pump 203, and the liquid is fed based on the feedback. This feedback control is independent of other controls.

Bubbles accumulated inside the circulation-side manifold 251 is exhausted to the outside of the liquid circulation path 400 through the exhaust path 300. The exhaust path 300 includes an exhaust valve 301, an exhaust tank 310, an air pressure adjuster 311, and an air pump 312. In the exhaust path 300, the exhaust tank 310 is provided with a tank weight sensor 313 and an air pressure sensor 314 communicating with the interior of the exhaust tank 310 to measure the air pressure in the exhaust tank 310.

The exhaust valve 301 is a connection valve that opens and closes a path between the liquid circulation path 400 and the exhaust path 300. The exhaust valve 301 is disposed so as to open the upper portion of the circulation-side manifold 251 to exhaust bubbles accumulated in the upper portion of the circulation-side manifold 251. The exhaust valve 301 can be opened and closed according to an open/close signal from the controller 60. The exhaust tank 310 accumulates fluid that flows in via the exhaust valve 301, which is gas, liquid, or a mixture thereof. The air pump 312, which is disposed downstream from the exhaust tank 310, exhausts the gas while the liquid is stored in the exhaust tank 310. The tank weight sensor 313 measures the weight of content in the exhaust tank 310 to detect weight change. As the liquid is stored in the exhaust tank 310, the weight of content increases. The air pressure adjuster 311 adjusts the air pressure in the exhaust tank 310. The air pressure adjuster 311 controls the pressure in the exhaust tank 310 by adjusting the driving of the air pump 312 so as to match the output of the air pressure sensor 314 to a set value. The air pump 312 exhausts the gas in the exhaust tank 310 to the outside.

A description is given below of an aspect of the present embodiment for removing bubbles accumulated inside the circulation-side manifold 251. When the amount of dissolved oxygen in the liquid is increased (saturated), bubbles are generated due to cavitation by a pressure generation source when the liquid is discharged, and the bubbles are accumulated in the upper portion of the circulation-side manifold 251. It is necessary to remove the bubbles, and a bubble exhaust operation is preferably performed while keeping the amount of dissolved oxygen low without stopping the operation of the supply system. Therefore, in the present embodiment, the bubble exhaust operation is performed without stopping the circulation operation of the liquid circulation device 500.

The state of whether each nozzle 104 discharges liquid or not continues to change during image formation, and the vibration state of the meniscus of each nozzle 104 changes. Accordingly, it is not preferable to perform the bubble exhaust operation during image formation. Therefore, in the present embodiment, the bubble exhaust operation is not performed during image formation, and the bubble exhaust operation is performed when the circulation operation is stable without discharging liquid.

Figure 6:
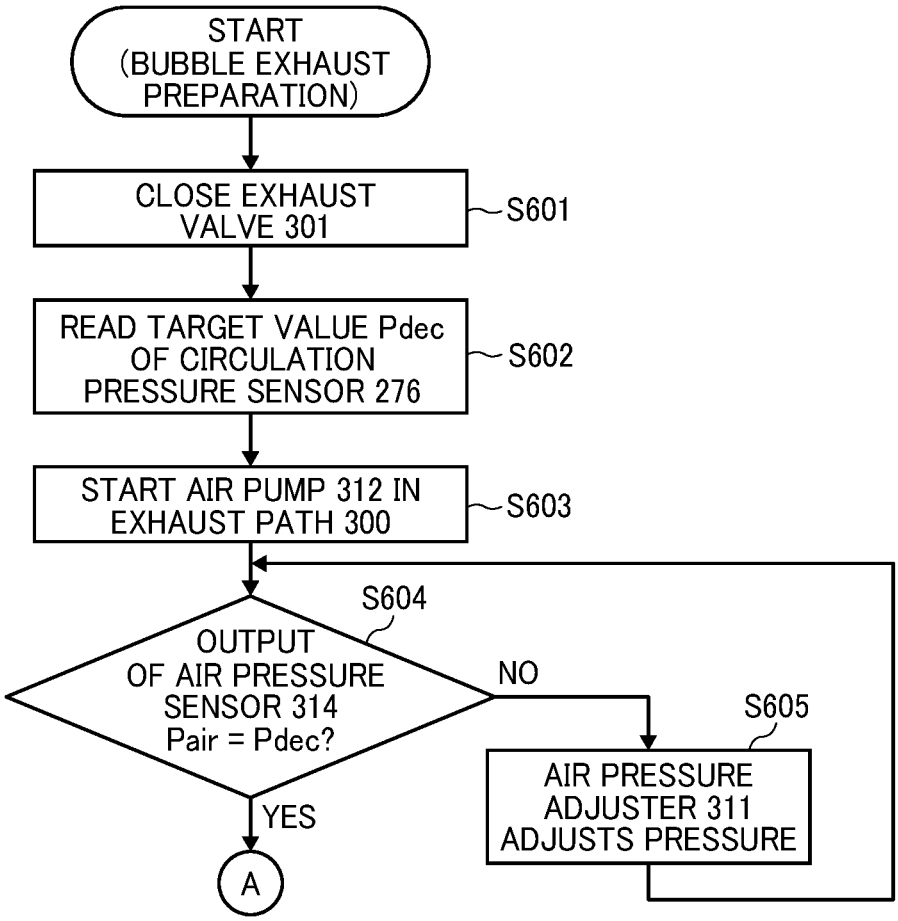
FIG. 6 is a flowchart illustrating an example of process of bubble exhaust preparation according to an embodiment of the present disclosure.

FIG. 6 is a flowchart illustrating an example of process of bubble exhaust preparation according to the present embodiment. After the image forming apparatus 1000 is turned on or after the print job ends, the controller 60 closes the exhaust valve 301 (closed state) (S601). The controller 60 reads a target value (Pdec) of the circulation pressure sensor 276 from the storage device (S602) and starts driving the air pump 312 (S603). The target value (Pdec) is the set value of liquid pressure when the circulation operation is stable and is set in advance. Then, the controller 60 operates the air pressure adjuster 311 to adjust the air pressure in the exhaust tank 310 so as to match an output value (Pair) of the air pressure sensor 314 to Pdec (NO in S604 and S605). When the output value (Pair) of the air pressure sensor 314 becomes Pdec (YES in S604), the process proceeds to the process illustrated in FIG. 7.

Figure 7:
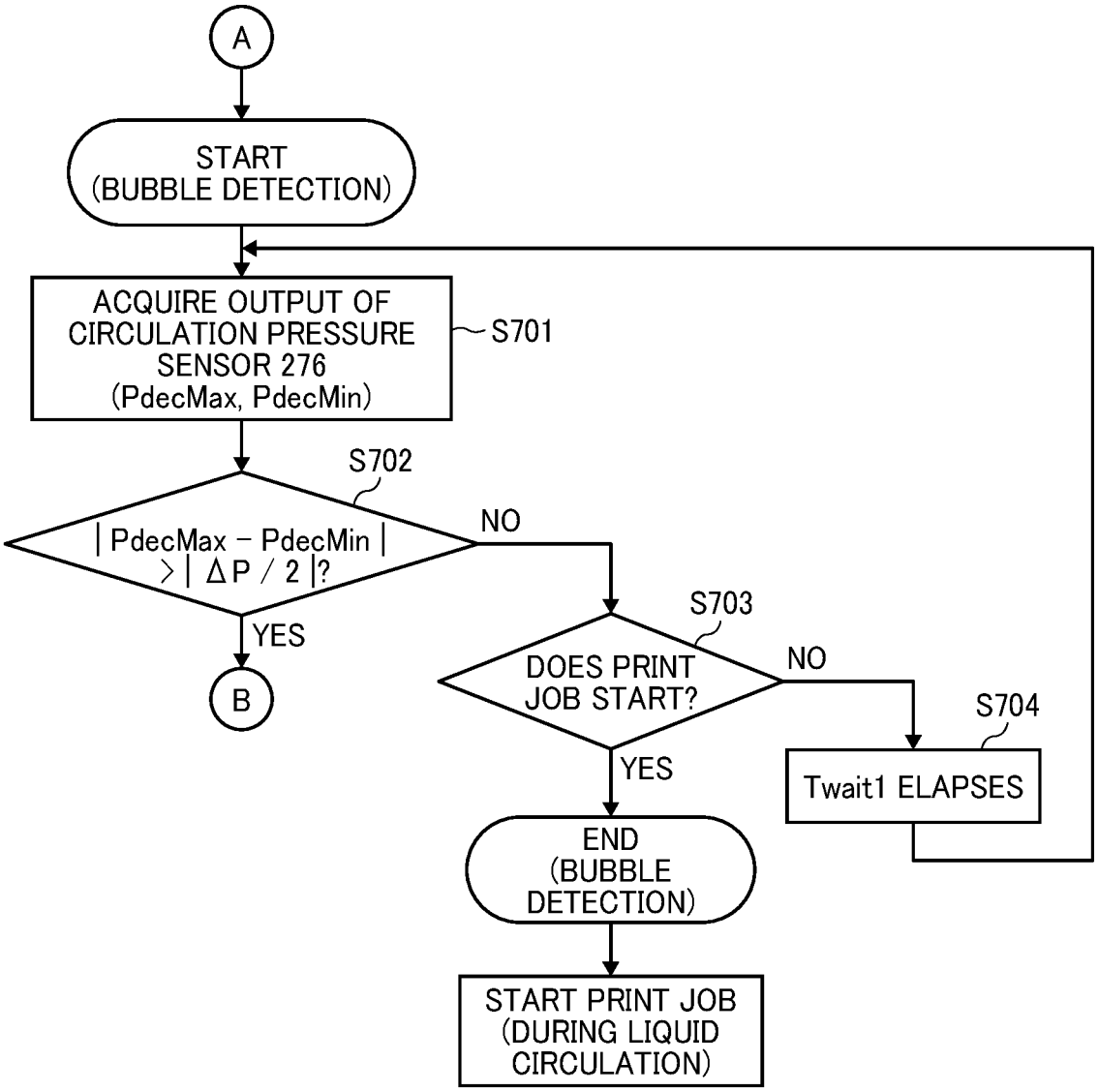
FIG. 7 is a flowchart illustrating an example of process of bubble detection according to an embodiment of the present disclosure.
Figure 8:
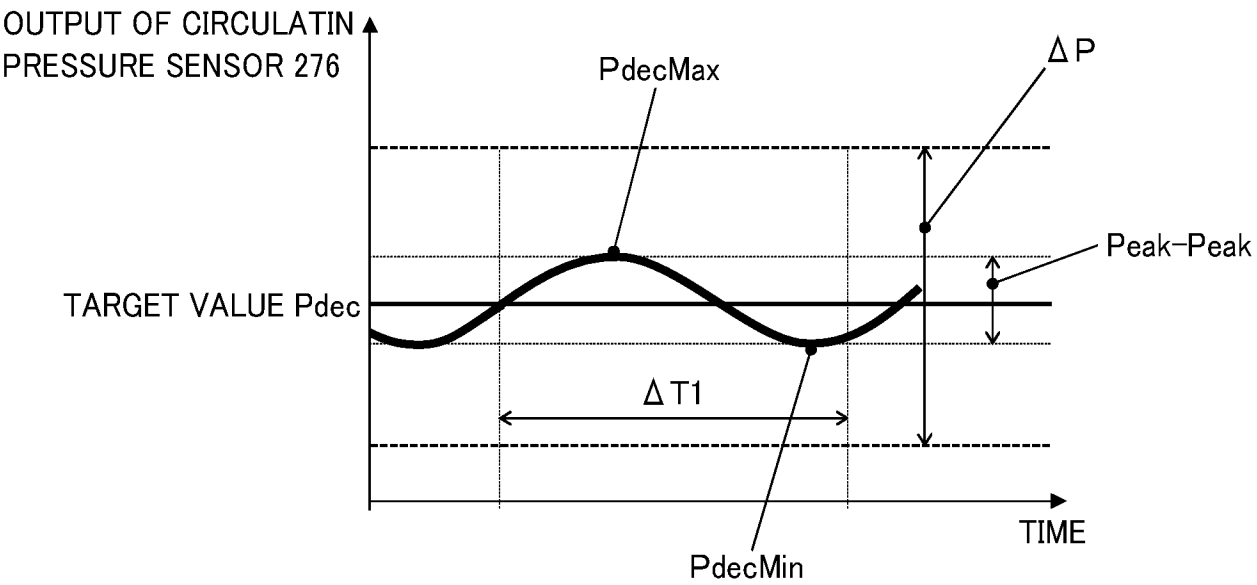
FIG. 8 is a graph illustrating an example of an output change of a circulation pressure sensor of the liquid circulation device over time.

FIG. 7 is a flowchart of an example of a process of bubble detection according to the present embodiment. This process is a process of detecting whether bubbles are mixed in the circulation-side manifold 251. FIG. 8 is a graph illustrating an example of output change of the circulation pressure sensor 276 over time. The controller 60 reads the output of the circulation pressure sensor 276 when the circulation operation is stable without discharging liquid (S701). At this time, the controller 60 acquires the maximum value (PdecMax) and the minimum value (PdecMin) of the circulation pressure sensor 276 in a predetermined time range ΔT1 (see FIG. 8).

Then, the controller 60 compares the difference between PdecMax and PdecMin with a threshold that is smaller than an allowable pressure range (ΔP) (S702). The difference between PdecMax and PdecMin indicates the amplitude of the output of the circulation pressure sensor 276 indicated by Peak-Peak in FIG. 8, which means the amount of output change of the circulation pressure sensor 276. Here, the allowable pressure range (ΔP) is a predetermined value determined from the allowable range of the meniscus pressure. The threshold is set to a value smaller than the allowable output range of the circulation pressure sensor 276, which is equal to ΔP, and larger than the amount of output change of the circulation pressure sensor 276 that is set at the time of initial setup of the image forming apparatus 1000. In the present embodiment, the threshold is ΔP/2, for example.

Figure 9:
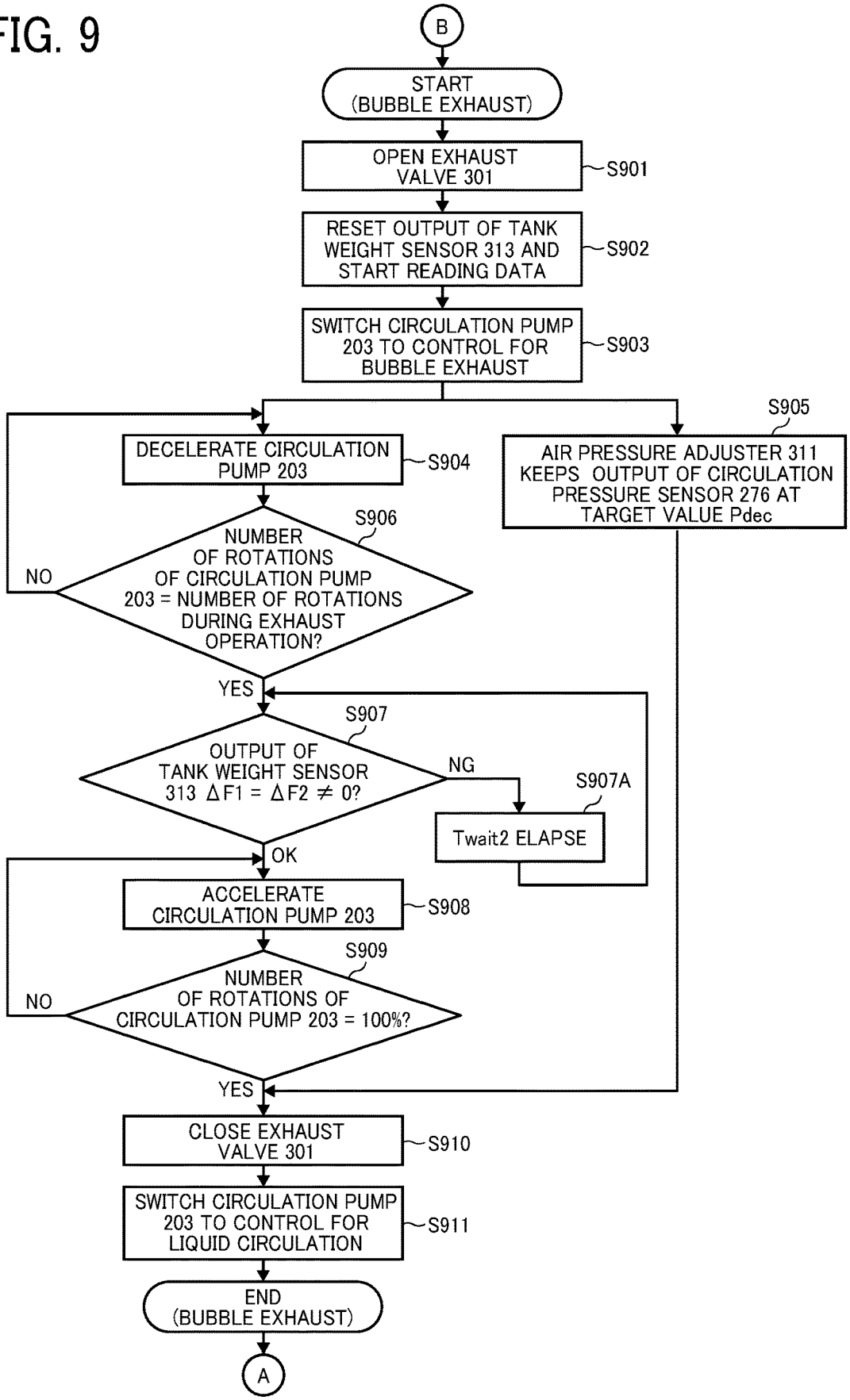
FIG. 9 is a flowchart illustrating an example of process of bubble exhaust operation according to an embodiment of the present disclosure.

When the amount of output change of the circulation pressure sensor 276 (Peak-Peak) exceeds the threshold (ΔP/2) (YES in S702), the controller 60 determines that bubbles are mixed in the circulation-side manifold 251, and starts the bubble exhaust operation (i.e., the process proceeds to the process in a flowchart illustrated in FIG. 9). When the amount of output change of the circulation pressure sensor 276 (Peak-Peak) does not exceed the threshold (ΔP/2) (NO in S702), the determination processes in steps S701 and S702 are repeatedly performed at each regular time interval Twait1 until the print job starts (NO in S703 and S704). When the print job starts (YES in S703), the bubble detection operation in FIG. 7 ends, and the print job is executed.

Figure 10A:
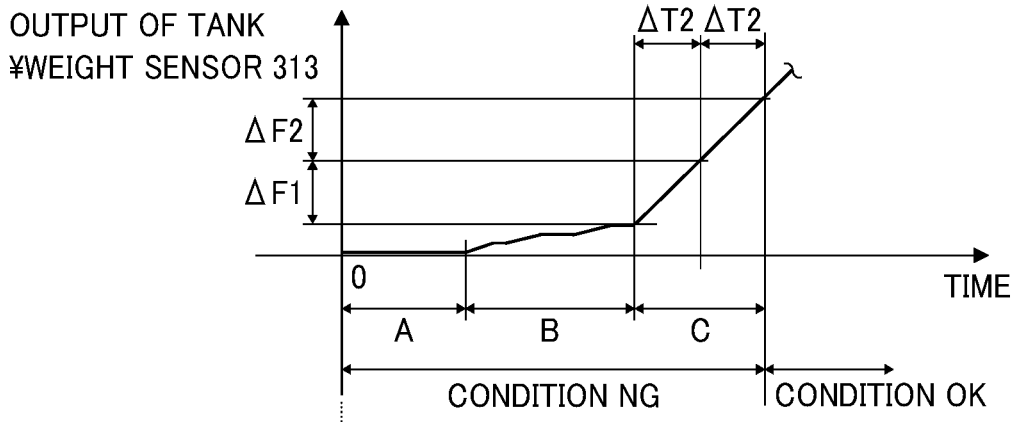
FIG. 10A is a graph illustrating an example of the output change of the circulation pressure sensor over time when the process illustrated in FIG. 9 is executed.

FIG. 9 is the flowchart illustrating an example of process of bubble exhaust control according to the present embodiment. FIG. 10A is a graph illustrating an example of the output change of the circulation pressure sensor 276 over time when the process illustrated in FIG. 9 is executed, and FIG. 10B is a graph illustrating an example of the encoder output of the circulation pump 203 when the process illustrated in FIG. 9 is executed.

When the controller 60 determines that bubbles are mixed in the circulation-side manifold 251 (YES in S702), the controller 60 opens the exhaust valve 301 of the exhaust path 300 (S901). At the same time, the controller 60 resets the output of the tank weight sensor 313 attached to the exhaust tank 310 to 0, and starts reading the encoder output built in the circulation pump 203 and the output of the tank weight sensor 313 (S902). The controller 60 switches only the circulation pump 203 to the control for the bubble exhaust operation (S903), and starts the control for the bubble exhaust operation (S905). At this time, since the operation of the supply system is not stopped, the control of the supply pump 202 is not switched. In this bubble exhaust operation, the controller 60 operates the air pressure adjuster 311 and the air pump 312 to control the output of the circulation pressure sensor 276 to the target value (Pdec) at the same time when the exhaust valve 301 is opened.

Figure 10B:
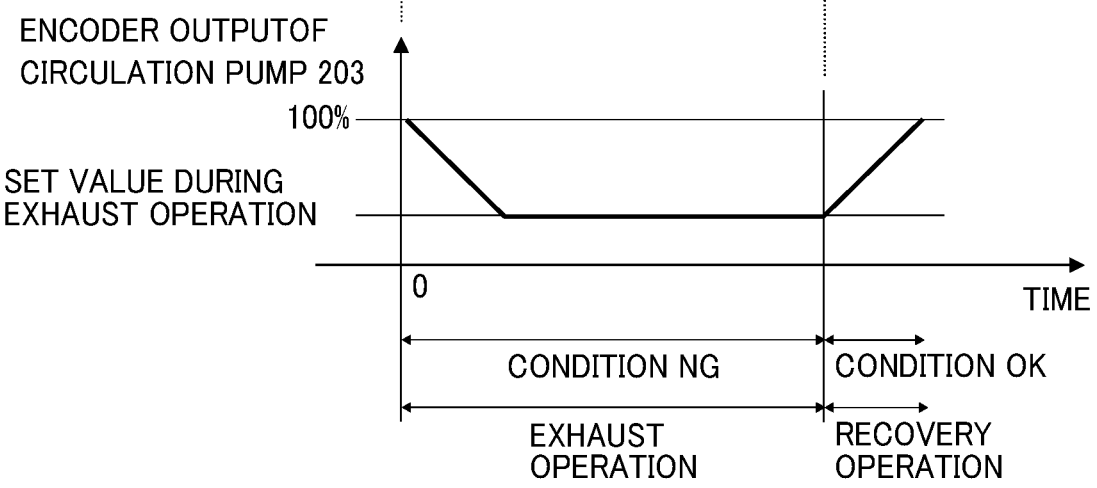
FIG. 10B is a graph illustrating an example of an encoder output change of a circulation pump of the liquid circulation device over time when the process illustrated in FIG. 9 is executed.

On the other hand, the controller 60 progressively decelerates the rotation speed of encoder (encoder output) of the circulation pump 203 (S904) in accordance with the control for the bubble exhaust operation (or as a part of the control for the bubble exhaust operation) (see FIG. 10B). The set values of the acceleration/deceleration and the rotation speed of the circulation pump 203 during the bubble exhaust operation are set to values determined based on product specifications.

Immediately after the start of the control for the bubble exhaust operation, only bubbles mixed in the circulation-side manifold 251 are exhausted through the exhaust valve 301, and thus only the bubbles flow into the exhaust tank 310. After a while, gas (bubbles) and liquid flow in a mixed state. Finally, almost all of the bubbles mixed in the circulation-side manifold 251 are exhausted, and only liquid is discharged from the circulation-side manifold 251.

FIG. 10A illustrates the state transition of the exhaust tank 310 indicated by the output of the tank weight sensor 313. When only bubbles flow into the exhaust tank 310 (i.e., the range A in FIG. 10A), since the weight of content inside the exhaust tank 310 does not change, the reading value of the tank weight sensor 313 remains almost 0. After a while, when bubbles flow in with liquid (i.e., the range B in FIG. 10A), the weight of content inside the exhaust tank 310 progressively increases. Since the mixing ratio between the bubbles and the liquid at this time is unstable, the increase in weight is also unstable as illustrated in FIG. 10A. Finally, only liquid flows in (i.e., the range C in FIG. 10A). At this time, since the increase in weight per unit time is constant, the slope of the graph in FIG. 10A is also constant.

While only gas flows in, the controller 60 decelerates the circulation pump 203 to a constant rotation speed (i.e., the number of rotations during the bubble exhaust operation) (the loop of S904 and NO in S906) (see FIG. 10B). When the circulation pump 203 reaches a constant rotation speed (i.e., the number of rotations during the bubble exhaust operation), the controller 60 reads the output of the tank weight sensor 313 three times in a row at intervals of time ΔT2 for each predetermined time Twait2 and calculates an amount of first output change ΔF1 and an amount of second output change ΔF2 of the reading values of the tank weight sensor 313 (see FIG. 10A). Then, the controller 60 determines whether only liquid flows in (whether ΔF1=ΔF2≠0 is satisfied) or not (the loop of NG in S907 and S907A). The controller 60 makes the above determination based on whether or not the output of the tank weight sensor 313 has a constant slope in the graph illustrated in FIG. 10A. Among the three consecutive reading values, the amount of first output change ΔF1 is calculated from the first and second reading values, and the amount of second output change ΔF2 is calculated from the second and third reading values.

When only gas flow into the exhaust tank 310 (i.e., the range A in FIG. 10A), the reading value of the tank weight sensor 313 does not change. Accordingly, the amount of output change of the reading values indicates ΔF1=ΔF2=0. In this case, since a bubble exhaust condition (ΔF1=ΔF2≠0) is not satisfied (NG in S907), the controller 60 makes the above determination again after the time Twait2 elapses (S907A and S907). After a while, gas and liquid are mixed in the exhaust tank 310 (i.e., the range B in FIG. 10A). At this time, the reading value of the tank weight sensor 313 increases unstably (ΔF1 ΔF2: unstable state). Also in this case, since the bubble exhaust condition (ΔF1=ΔF2≠0) is not satisfied (NG in S907), the controller 60 makes the above determination again after the time Twait2 elapses (S907A and S907). When only liquid flows in (the range C in FIG. 10 A), the amount of output change of the tank weight sensor 313 indicates ΔF1=ΔF2≠0 (OK in S907). Therefore, the controller 60 determines that all the bubbles mixed in the circulation-side manifold 251 have been exhausted, and advances the process to the step S908.

After the controller 60 determines that the bubbles are completely exhausted, the controller 60 starts driving the circulation pump 203 at the predetermined acceleration (S908). Then, the controller 60 progressively accelerates the circulation pump 203 until the encoder output of the circulation pump 203 reaches 100% (the loop of S908 and No in S909) (see FIG. 10B). Here, the average encoder output when the circulation operation is stable is 100% (i.e., stable state), which is set at the time of initial setup of image forming apparatus 1000.

During the above-described bubble exhaust operation, the controller 60 keeps the output of the circulation pressure sensor 276 at the target value (Pdec) by the air pump 312 and the air pressure adjuster 311 (see S905). Therefore, when the encoder output reaches 100%, the controller 60 closes the exhaust valve 301 (S910) and returns the control of the circulation pump 203 to the normal circulation operation (S911). That is, the controller 60 closes the exhaust valve 301 when the output of the tank weight sensor 313 transits from the unstable state to the stable state.

According to the above-described embodiments, bubbles accumulated inside the liquid circulation path can be exhausted to the outside of the liquid circulation path, and the bubbles do not return to the inside of the liquid circulation path. Therefore, it is easy to control the gas volume in the tank of the liquid circulation path to be constant, and the feedback control of the liquid feed pump by the liquid pressure sensor of the liquid circulation path is not disturbed. As a result, the meniscus pressure in the nozzles of the liquid discharge head does not become unstable, and the image quality of images formed on the recording medium does not deteriorate.

As described above, according to the present embodiment, bubbles in the liquid circulation path can be removed, and the image quality of the image formed on the recording medium can be prevented from deteriorating.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), DSP (digital signal processor), FPGA (field programmable gate array) and conventional circuit components arranged to perform the recited functions.

What is claimed is:

1. A liquid discharge apparatus comprising:

a liquid discharge head configured to discharge liquid;

a liquid circulation path including the liquid discharge head, the liquid circulation path configured to circulate the liquid via the liquid discharge head;

an exhaust path connected to the liquid circulation path on a downstream side of the liquid discharge head in a circulation direction of the liquid; and circuitry configured to open and close between the liquid circulation path and the exhaust path to exhaust bubbles in the liquid circulation path to an outside of the liquid circulation path through the exhaust path when the liquid is circulated in the liquid circulation path, wherein the exhaust path connects the liquid circulation path to an outside of the liquid circulation path, and wherein the exhaust path includes:

an exhaust valve configured to open and close a path between the liquid circulation path and the exhaust path, an exhaust tank configured to accumulate fluid flowing through the exhaust valve;

an air pressure adjuster configured to adjust an air pressure in the exhaust tank, and an air pump configured to exhaust gas in the exhaust tank to an outside of the liquid discharge apparatus.

2. The liquid discharge apparatus according to claim 1, wherein the liquid circulation path further includes a circulation-side manifold including a liquid pressure sensor downstream from the liquid discharge head, wherein the exhaust path is connected to the circulation-side manifold to exhaust the bubbles in the circulation-side manifold to the outside of the liquid circulation path through the exhaust path, and wherein the circuitry is configured to open the exhaust valve when an amplitude of an output of the liquid pressure sensor becomes larger than a threshold.

3. The liquid discharge apparatus according to claim 2, wherein the liquid circulation path further includes a liquid feed pump downstream from the circulation-side manifold, and wherein, when the exhaust valve is open, the circuitry is configured to decrease a rotation speed of the liquid feed pump below the rotation speed when the exhaust valve is closed and to control the air pressure adjuster and the air pump to adjust the output of the liquid pressure sensor to a set value of liquid pressure.

4. The liquid discharge apparatus according to claim 1, wherein the circuitry is configured to close the exhaust valve when an output of the tank weight sensor transits from an unstable state to a stable state.

5. The liquid discharge apparatus according to claim 1, wherein the exhaust tank includes:

an air pressure sensor configured to measure an air pressure in the exhaust tank; and a tank weight sensor configured to measure a weight of content in the exhaust tank.

* * * * *